US006049068A

United States Patent [19]

Logan

[11] Patent Number: 6,049,068

[45] Date of Patent: Apr. 11, 2000

[54] REPLACEABLE AND RETRACTABLE BURNER FOR AN ELECTRICAL RANGE

[75] Inventor: Eugene T. Logan, Salina, Kans.

[73] Assignee: Sigma Industries, Inc., Salina, Kans.

[21] Appl. No.: 09/323,640

[22] Filed: Jun. 1, 1999

[51] Int. Cl.[7] ..... H05B 3/68

[52] U.S. Cl. ..... 219/453.11

[58] Field of Search ..... 219/453.11, 453.12, 219/453.13, 454.12, 455.11, 446.1, 448.12, 415, 416, 417, 418; 248/282.1, 283.1, 207

[56] References Cited

U.S. PATENT DOCUMENTS

| | | | |
|---|---|---|---|
| 1,399,696 | 12/1921 | De Roo . | |
| 1,825,406 | 9/1931 | Lipman . | |
| 2,528,579 | 11/1950 | Clark | 219/35 |
| 2,635,172 | 4/1953 | Rutenber | 219/37 |
| 2,664,495 | 12/1953 | Wehrli | 219/43 |
| 2,761,053 | 8/1956 | Schneider | 219/37 |
| 2,825,790 | 3/1958 | Sims | 219/37 |
| 3,384,736 | 5/1968 | Nowosielski | 219/453.11 |
| 3,440,406 | 4/1969 | Sego, Jr. . | |
| 3,578,951 | 5/1971 | Ingrao . | |
| 3,586,824 | 6/1971 | Barney | 219/446.1 |
| 3,700,856 | 10/1972 | Kullman . | |
| 3,898,430 | 8/1975 | Sego, Jr. et al. . | |
| 4,206,341 | 6/1980 | Leuschner et al. | 219/283 |
| 5,084,608 | 1/1992 | Logan | 219/459 |
| 5,136,142 | 8/1992 | Logan . | |
| 5,695,417 | 12/1997 | Winter et al. | 248/483.1 |

*Primary Examiner*—Sang Paik
*Attorney, Agent, or Firm*—Head, Johnson and Kachigian

[57] ABSTRACT

A cam actuated retractable burner for an electric range having a removable burner element. In one exemplary embodiment of the invention, a burner assembly is provided with a thermal safety switch assembly, a switch installation assembly, a preset thermal switch, a heating element actuator, associated control knobs for the heating actuator, a heating element assembly, a vessel support assembly, and a drip bowl. The present invention represents an improved method of raising and lowering an electrical element for improved cooking characteristics. The present invention allows the user to obtain radiant heat transfer for more even cooking while still allowing traditional conductive heat transfer cooking.

7 Claims, 7 Drawing Sheets

REPLACEABLE AND RETRACTABLE BURNER FOR AN ELECTRICAL RANGE

BACKGROUND OF THE INVENTION

The present invention is directed to an apparatus and method for controlling the positioning and heat transfer from an electrical heating element to a vessel being heated. More particularly, the invention is directed for use in electric ranges with electrical heating elements. The invention has utility in applications such as newly manufactured ranges, or can be installed as a replacement for old burners in a previously installed electric range.

The placing of moveable electric elements in electric ranges is known in the prior art. Retractable burners for electric range systems are shown in U.S. Pat. No. 5,084,608, issued to Logan on Jan. 28, 1992; and U.S. Pat. No. 5,136,142, issued to Logan on Aug. 4, 1992. Each of these patents is briefly outlined in the following discussion, and is hereby incorporated by reference.

U.S. Pat. No. 5,084,608, issued to Logan on Jan. 28, 1992 discloses a "Retractable Burner For An Electric Range". This system discloses a method for raising and lowering an electric range burner element independently of the item being heated. The cookware rests on top of a plurality of support posts instead of resting directly on the electric burner element. The supporting posts and the cookware are fixed to the range surface and stay at a fixed level while the burner element can be raised and lowered with respect to the top of the support posts. A control knob raises and lowers the burner element in a parallel relationship to the bottom surface of the cookware. In this manner, traditional direct heating can be obtained when the element is raised against the bottom of the cookware, or a radiant gentle heat may be obtained by lowering the burner element away from the bottom of the cookware. This also allows for an on-stove cooling method by leaving the cookware on the burner surface while lowering the burner element from the cookware.

U.S. Pat. No. 5,136,142, issued to Logan on Aug. 4, 1992 discloses a "Retractable Burner For An Electric Range Having A Removable Burner Element". This specification discloses an improvement upon U.S. Pat. No. 5,084,608 by using a pivotal electrical connection to permit assembly and convenient unplugging and removal of the burner element. This allows for disassembly and cleaning of the apparatus of the invention and the reflective bowl connection to the range top.

The systems disclosed in these patents do not appear to allow for a front surface mounting of a control knob for raising and lowering the electric burner in relation to the cookware. In addition, these prior art systems do not appear to disclose a method for properly aligning and supporting a removable electric range element at the raised and lowered positions. Finally, these prior art systems do not disclose the use of a preset thermal switch for controlling the maximum temperature of the electrical burner element when in the lowered position. Hence, there is a need for an improved method for mounting a replaceable and retractable burner element for an electric range. In addition, there may be a need on some ranges for a thermal safety switch for a raised and lowered heating element for an electric heating element to protect the surrounding range components such as electrical wiring.

BRIEF SUMMARY OF THE INVENTION

In accordance with the present invention, an improved mounting apparatus and method is provided which addresses the drawbacks of the prior art devices.

In accordance with one embodiment of the present invention, an improved method and apparatus for a replaceable and retractable heating element for an electric range is provided comprising an actuator assembly with appropriate external controls.

In accordance with one example of the present invention, the unit is equipped with a receptacle support assembly for existing type burner receptacles.

In accordance with yet another example, the unit is equipped with a thermal safety switch.

In accordance with yet another example, the unit is equipped with a switch installation which is controlled by the same controlling apparatus as the actuator assembly.

In accordance with a further example, the unit is equipped with a drip bowl, burner assembly, and a hold down weight.

In accordance with a further example, the unit is equipped with a preset thermal switch.

The principal object of the present invention is to provide a method for raising and lowering an electrical burner element in relation to the vessel being heated.

Another object of the present invention is to provide a method of connection for an existing type burner receptacle to allow raising and lowering the burner element in parallel relationship to the vessel being heated.

A further object of the present invention is to provide a thermal safety switch for a replaceable type raised and lowered burner assembly.

A still further object of the present invention is to provide a burner assembly which provides the user with the option of obtaining substantially the same rapid cooling characteristics that are obtainable with the use of a gas range. By uniformly supporting the cookware on vessel support tabs above a lowered electric burner element in a parallel plane, the heat transfer to the bottom surface of the cookware can be reduced.

An additional object of the present invention is to provide an electric cooking element which can be used in a raised and lowered position. In the lowered position, the heating element can provide gentle radiant heat which is useful for simmering foods, such as puddings, sauces, gravies or soups.

Another object of the invention is to provide a self-aligning leveling collar. This collar allows the top of the burner element to self-align the vessel being heated. The collar is spring loaded and biased to controllably hold the assembly, but to still allow movement of the burner assembly to self-align with the vessel.

Another object of the invention is to provide leveling stops. These stops provide leveling in the raised position when no vessel is in place and limit movement of self-aligning element. Also, in the lowered position they force the element to set level as it rests on the upper part of the leveling stop.

Other objects and further scope of the applicability of the present invention will become apparent from the detailed descriptions to follow, taken in conjunction with the accompanying drawings wherein like parts are designated by like reference numerals.

DETAILED DESCRIPTION OF THE PREFERRED EMBODIMENTS

Figure 1:
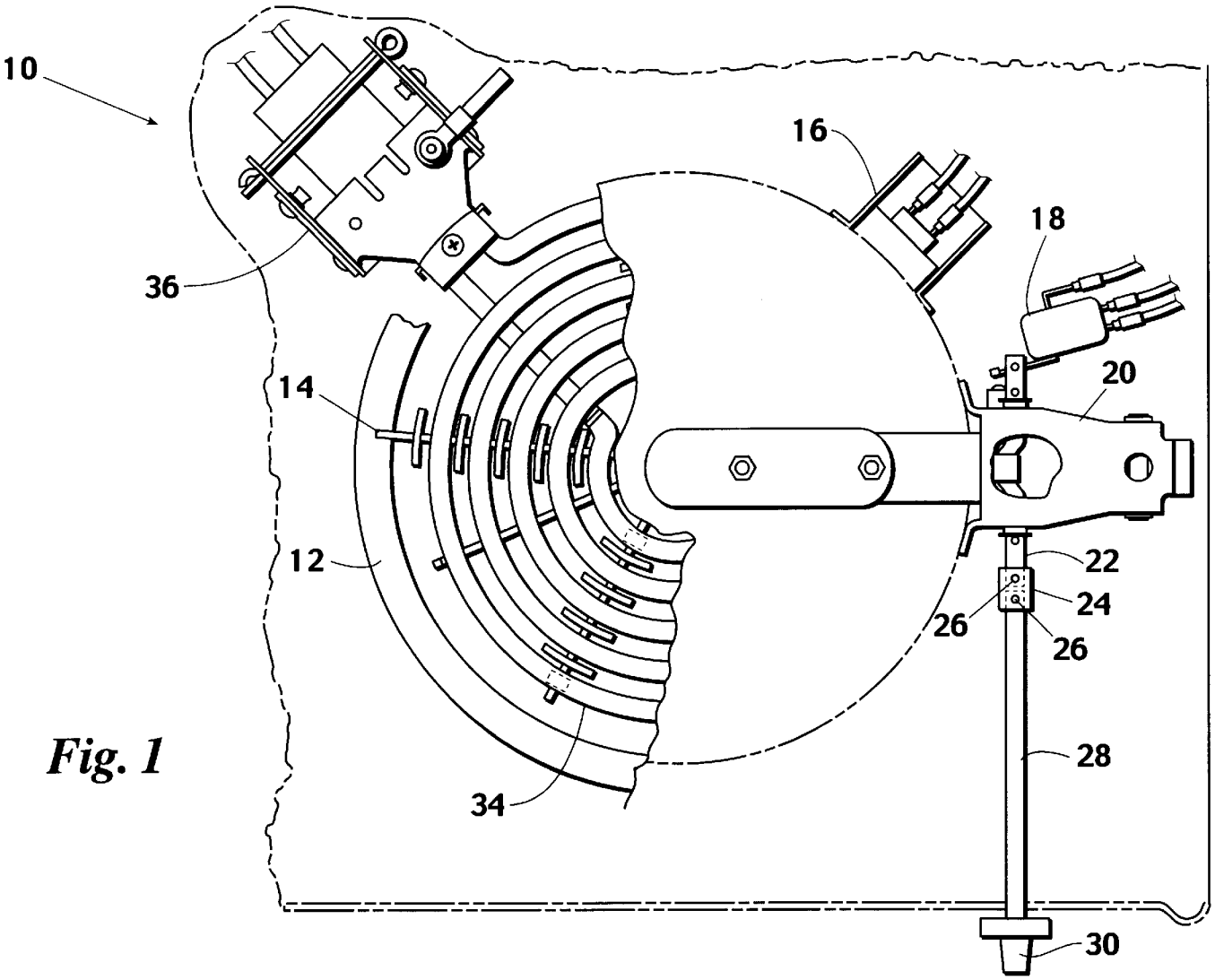
FIG. 1 is a top view of the replaceable, retractable burner assembly of the present invention.

In accordance with an exemplary embodiment of the present invention as shown in FIG. 1, a retractable replacement burner element apparatus, device, or assembly is generally designated by the reference numeral 10. The burner assembly 10 includes as a main components a drip bowl 12, a vessel support subassembly 14, a thermal safety switch subassembly 16, a switch installation subassembly 18, a heating element actuator subassembly 20, a heating element subassembly 34, and a heating element connector receptacle subassembly 36.

With reference to FIG. 1, there is shown the basic embodiment of the invention consisting of the vessel support subassembly 14, the heating element actuator subassembly 20, and the heating element subassembly 34. The preferred embodiment of the present invention is supported on a standard style drip bowl 12. The drip bowl 12 is generally constructed from a steel, or other material suitable for high strength, high temperature applications. The drip bowl 12 may be constructed as a standard drip bowl known in the industry, such as either a chrome or black drip bowl manufactured by Rangekleen® in Lima, Ohio. Drip bowl 12 acts as the main support for several of the elements of the burner assembly 10.

The drip bowl 12 acts as a main support for the vessel support subassembly 14, and in turn, the drip bowl 12 is supported by the range top. The vessel support subassembly 14 is designed to support the weight of the cooking vessel, pots, pans, or other items to be heated with the heating element subassembly 34.

Figure 3:
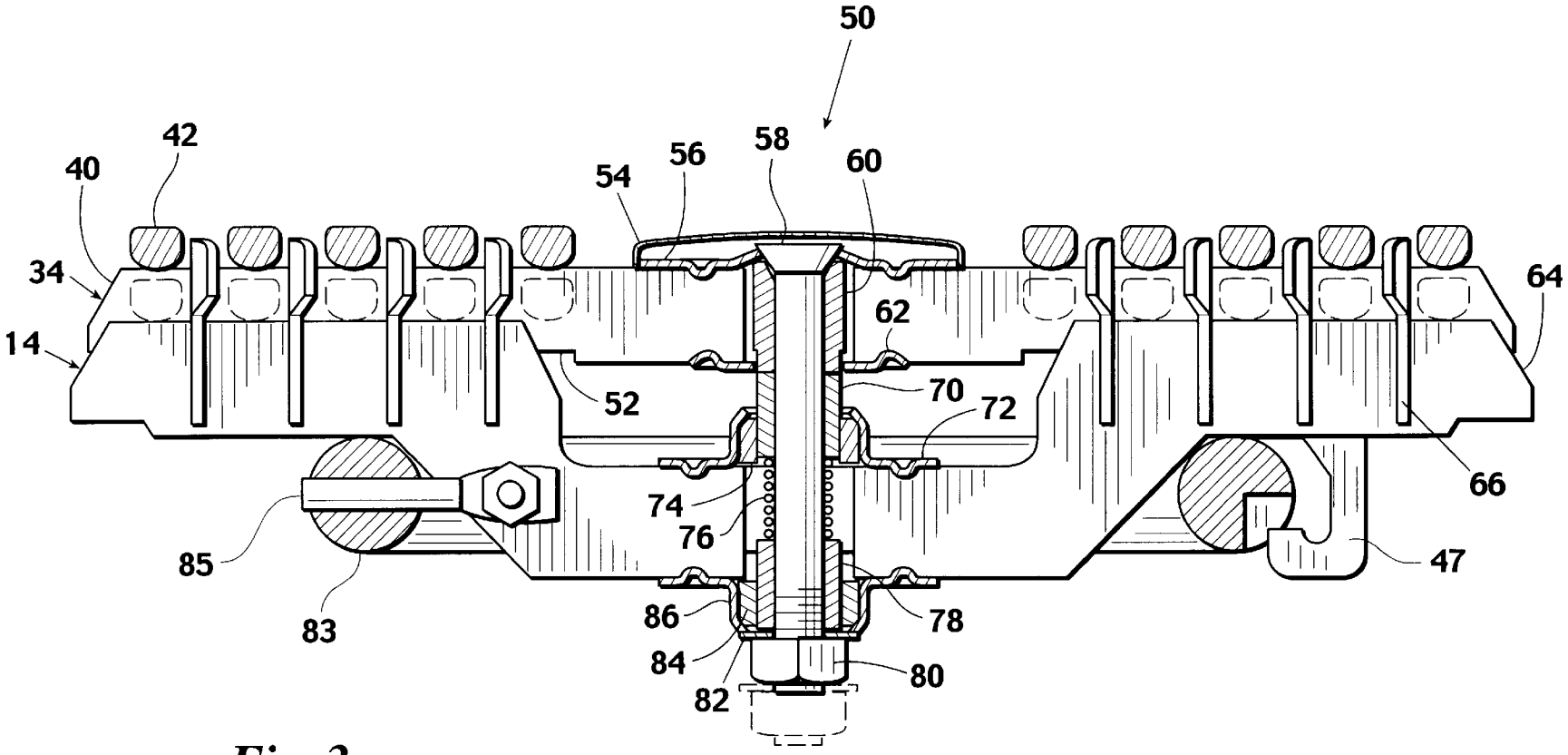
FIG. 3 is a cut away side view of the heating element subassembly combined with the vessel support subassembly along the line A—A as shown in FIG. 2.
Figure 4:
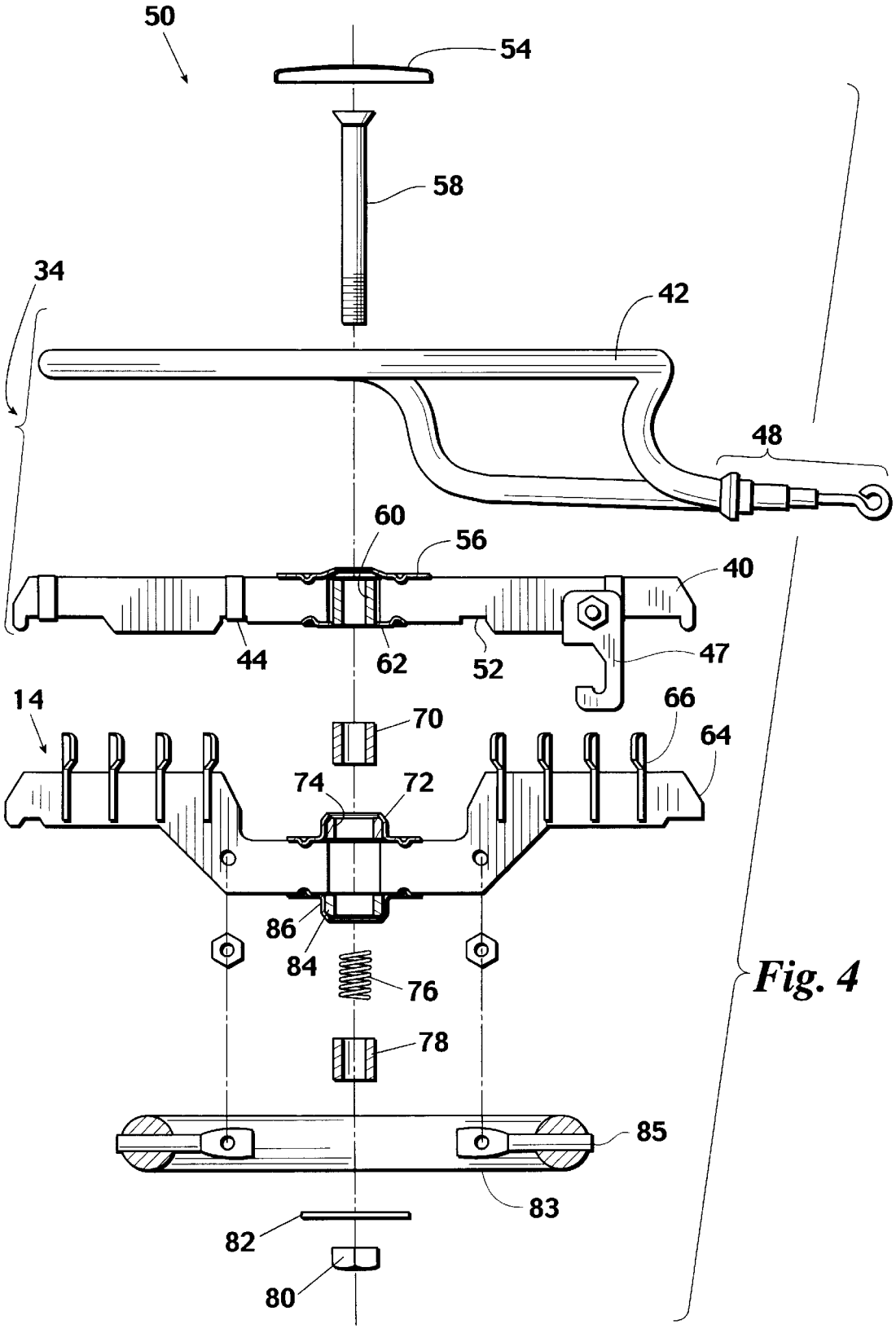
FIG. 4 is an exploded view of the heating element subassembly and vessel support subassembly of the burner assembly of FIG. 1.

The heating element subassembly 34 is attached to the vessel support subassembly 14 through the vertical connecting assembly 50 which is shown in FIG. 3. The heating element subassembly 34 operates in conjunction with the vessel support subassembly 14 to control the amount of heat transfer into the vessel being heated. This connection will be further described infra.

The subassembly 16 is supported off of the range top orifice flange. The subassembly 16 is designed to provide thermostatic limit control for protection of the heating element subassembly 34 and surrounding area. The subassembly 16 is also attached to the range top orifice flange by standard connection methods.

The range top orifice flange also acts as a main support for the heating element actuator subassembly 20. The heating element actuator subassembly 20 is attached to the range top orifice flange by standard connection methods, such as rivets, screws, bolts, welding, adhesives or the like.

The switch installation subassembly 18 is mounted to the heating element actuator subassembly 20. The switch installation subassembly 18 controls the maximum temperature at which the heating element subassembly 34 operates. Switch installation subassembly 18 is controlled by the heating element actuator shaft 22. The heating element actuator shaft 22 is formed from a 7/32" or 1/4" diameter stainless steel round or zinc plated steel round.

The heating element actuator shafts 22 operates both the switch installation subassembly 18 and the heating element actuator subassembly 20. The heating element actuator shafts 22 is connected to the knob shaft 28 through shaft coupling 24. Shaft coupling 24 is pinned to the heating element shaft 22 and the knob shaft 28 by shaft pins 26. The exposed end of the knob shaft 28 is connected to knob 30 for operation by the user. The knob shaft 28 is formed from a 7/32" or 1/4" diameter stainless steel round or zinc plated steel round.

The heating element subassembly 34 is connected to its external power source through the heating element connector receptacle subassembly 36.

Each of the various subassemblies of the burner assembly 10 shall be further described in the following discussion.

Figure 2:
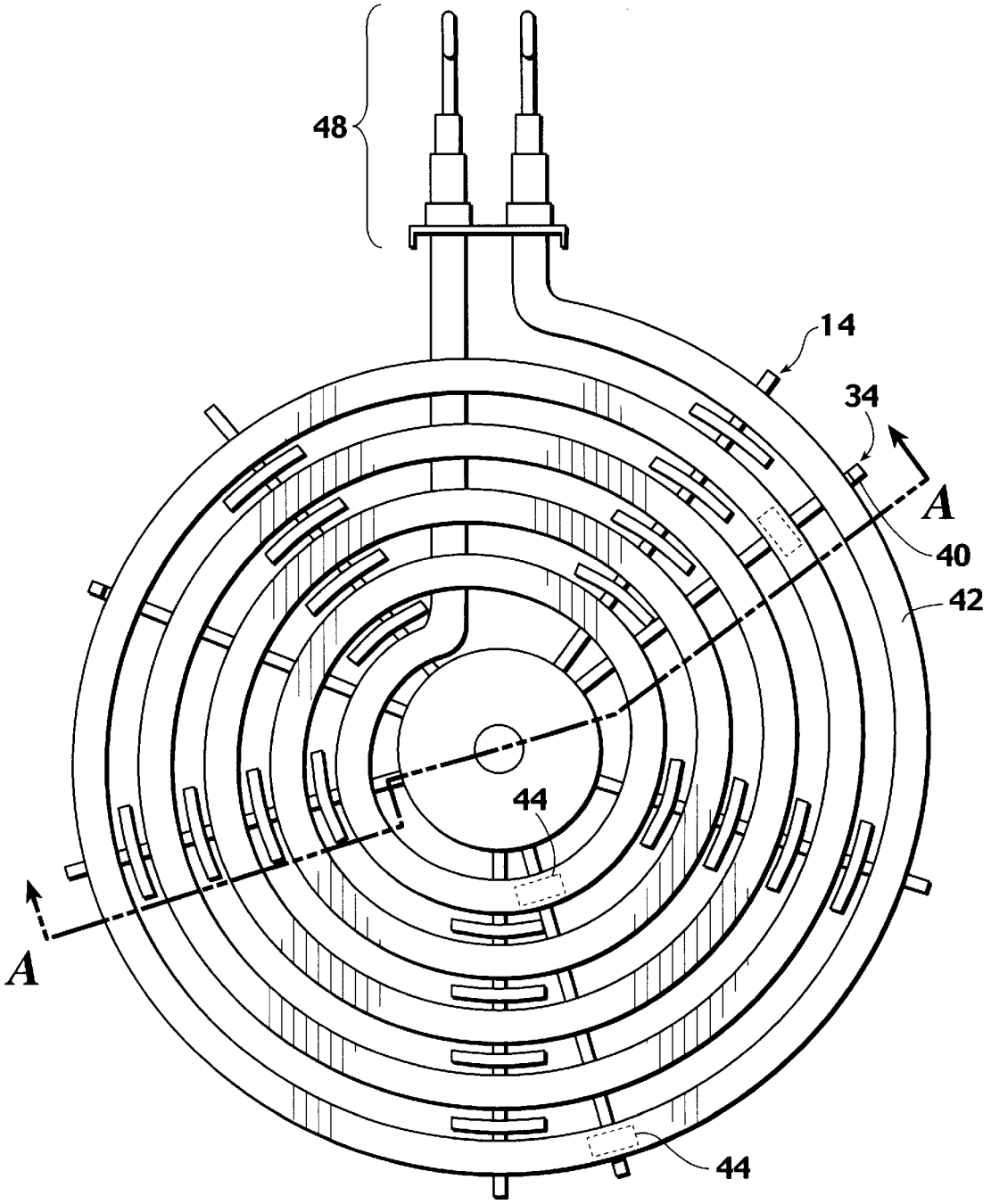
FIG. 2 is a top view of the heating element subassembly in relational arrangement to the vessel support subassembly of the burner assembly of FIG. 1.

As shown in FIG. 2 of the drawings, the vessel support subassembly 14 is operatively nested with the heating elements subassembly 34. The heating element subassembly 34 is made up from heating element support arms 40 which are connected to the heating element 42. The heating element support arm 40 is constructed from a 0.060 stainless steel with an approximate width of 0.625 inches. A typical heating element 42 is one such as a Chromalox® ME-type burner. General requirements for the heating element 42 can be found in industry standards. In general, the heating element 42 is a large unit approximately 8 inches in diameter, 2100 watts to 2600 watts at 240 volts.

The connection between the heating element support arms 40 and the heating element 42 is made by an attachment clip 44. The attachment clip 44 is resistance welded to the heating element 42 in a manner appropriate for the particular type of heating element 42 being used. At least one resistance welded clip 44 is mounted on the innermost turn of the burner 42. It is preferred that the innermost clip 44 is placed opposite the burner connection terminal 48.

Because the burner connection terminal 48 shifts the center of balance of the heating element subassembly 34 off of the center of the heating element 42, a leveling stop 47 is used at 3 locations to level the heating element subassembly 34 against vessel support subassembly 14 for proper operation of the unit. This prevents excessive tipping of the element subassembly 34 but still allows freedom to properly contact the bottom of the vessel.

FIGS. 3–6 show the heating element sub assembly 34 and the vessel support sub assembly 14.

FIG. 3 shows a cut-away view along line A—A of FIG. 2. This view shows the heating element subassembly 34 attached through the vertical connecting assembly 50 to the vessel support subassembly 14. The construction of each of the subassemblies will be further described herein. In addition, the working relationship of the subassemblies will be outlined in the following discussion.

The heating element subassembly 34 mainly consists of the heating element support arms 40 and the heating element 42. Slot 52 on the heating element support arm 40 is designed to hold the resistant welded attachment clip 44 on the innermost turn of the burner 42. The heating element support arms 40 are supported through an upper element hub plate 56 and a lower element hub plate 62. The upper element hub plate 56 is constructed of a 0.048 (18 gauge) stainless steel. A similar material is used for the lower element hub plate.

The heating element support arms 40 are resistance welded to both the upper hub plate 56 and the lower hub plate 62. A screw collar 60 is mounted between the upper element hub plate 56 and the lower element hub plate 62. The screw collar 60 is formed for a ½ inch diameter brass round. This screw collar 60 will allow the heating element subassembly 34 to be leveled with the vertical connecting assembly 50.

FIG. 3 shows the heating element subassembly 34 in the raised position, and the dashed lines indicate the position of the heating element subassembly 34 in its lowered position. Note that the heating elements subassembly 34 changes its relative position against the vessel support subassembly 14.

The heating element subassembly 34 is connected through the vertical connecting assembly 50 to the vessel support subassembly 14. A medallion 54 is placed over the vertical connecting assembly 50 for appearance purposes. The medallion 54 is formed from a 0.024 stainless steel or coated or plated steel. The medallion 54 can be designed to interlock with the upper element hub plate 56 so that the medallion 54 remains attached to the heating element subassembly 34 while in operation. The medallion 54 covers the connection between the vertical connection screw 58 and the heating element subassembly 34. The vertical connection screw 58 fits through the upper element hub plate 56, the screw collar 60 and exits through the lower element hub plate 62. This vertical connection screw 58 holds the heating element subassembly 34 in a substantially parallel relationship to the vessel support subassembly 14.

FIG. 3 also shows the hold down weight 83 and the weight support pins 85. The hold down weight 83 is constructed of ⅝" diameter steel or stainless steel round. The support pins 85 are constructed of 3/16" diameter steel or stainless steel round. The hold down weight 83 is designed to prevent lifting of the vessel support subassembly 14 if the slidable components described infra were to develop an increased coefficient of friction because of manufacturing variations, foreign material or lack of lubrication.

The stick-slip type of movement resulting from the above condition will manifest itself when the heating element subassembly is raised to the H1 position when there is no cooking vessel in place. This irregular movement as observed and evaluated by a prospective buyer could result in a reduced perceived value and lack of sale.

Figure 5:
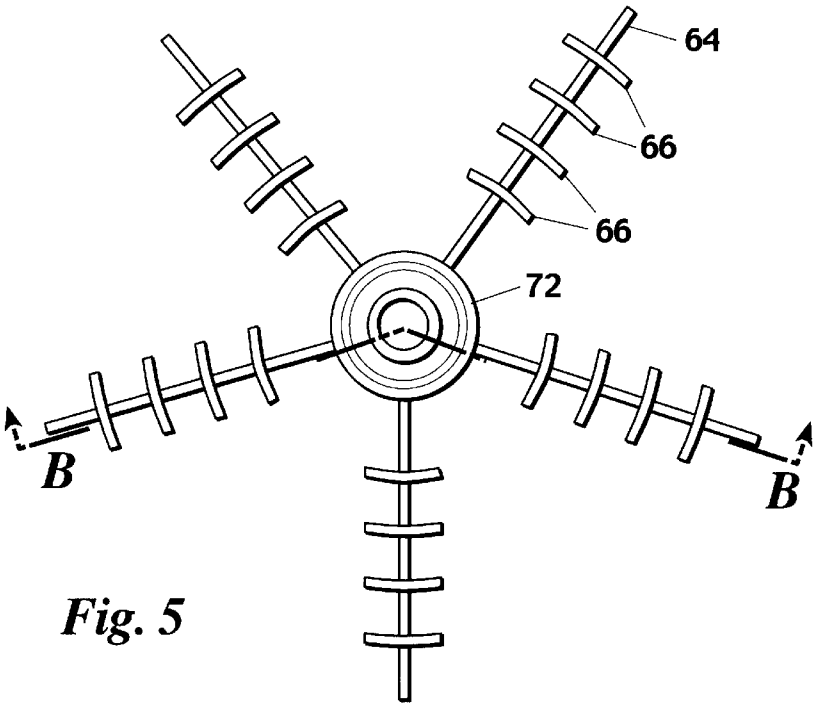
FIG. 5 is a top view of the vessel support subassembly.
Figure 6:
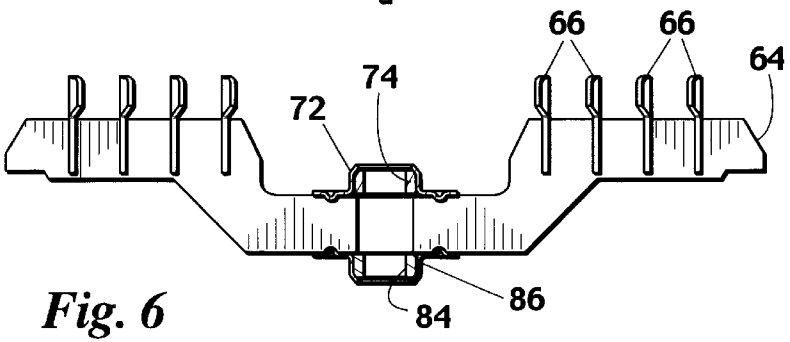
FIG. 6 is a cut away side view of the vessel support subassembly along the line B—B as shown in FIG. 5.

As further shown in FIGS. 5 and 6, the vessel support subassembly 14 consists of vessel support arms 64 which hold the vessel support tabs 66. The vessel support arms 64 are constructed from a 0.060 stainless steel with an approximate width of 1.4 inches. The vessel support tabs 66 are generally constructed from a 0.075 stainless steel with an approximate width of 0.75 inches.

Returning to FIGS. 3 and 4, the vessel support tabs 66 are designed to fit within the openings of the turns of the heating element 42. In this manner, the vessel support tabs 66 can extend through the heating element 42 in both a raised and lowered position to support the weight of the vessel (not shown) and transfer this weight to the drip bowl 12. The ends of the vessel support arms 64 rests on drip bowl 12.

The vessel support arms 64 are resistance welded into the upper vessel hub plate 72 and the lower vessel hub plate 86. The upper vessel hub plate 72 and lower vessel hub plate 86 are constructed from a 0.048 stainless steel. The combination of the vessel support arms 64, the upper vessel hub plate 72, and the lower vessel hub plate 86 provides a solid foundation for mounting the upper center post sleeve 74 and the lower center post sleeve 84. The upper center post sleeve 74 and lower center post sleeve 84 are formed from a machinable aluminum silicate bar which is fired and polished. These sleeves 74 and 84 support the operation of the vertical connecting assembly 50. The upper center post sleeve 74 supports the upper screw sleeve 70 which supports vertical connecting screw 58. The lower center post sleeve 84 supports the lower screw sleeve 78 which also supports the vertical connection screw 58. Thus, it can be seen the post sleeves 74 and 84 support the screw sleeves 70 and 78 which support the vertical connection screw 58 in a substantially vertical manner. Note that each of the connections between the post sleeves 74 and 84 and the screw sleeves 70 and 78 as well as the connection between the screw sleeves 70 and 78 and the vertical connection screw 58 are designed to be slidable connections with little resistance. This allows for the vertical connection screw 58 to be vertically adjustable.

The entire heating element subassembly 34 is raised and lowered by the flat spring 100 of the heating element actuator 20 working on the center post 58 of the vertical support assembly 50.

The self-aligning of element 42 may be seen by the connection of the upper screw sleeve 70 through the center post spring 76 to the lower screw sleeve 78. The center post spring 76 is constructed from spring temper Inconel X-750 wire with approximately 6½ total coils in an LH helix pattern. In this manner, weight from the vessel can be transferred from the heating element 42 through the heating element subassembly 34 to the heating element actuator 20 and onto the range top. When the heating element subassembly 34 is in its raised position in comparison to the vessel support subassembly 14, the top surface of the heating element 42 is raised above the top of the vessel support tabs 66. By raising the upper surface the heating element 42 above the vessel support tabs 66, direct contact between the upper surface of the heating element 42 and the vessel to be heated may be obtained. However, it is only desired that contact between the heating element 42 and the vessel be obtained, and not that the heating element subassembly 34 actually support the weight of the vessel. In order to allow for the heating element 42 to fully contact the bottom of the vessel being heated, it is desirable that the heating element 42 float in relation to the vessel support subassembly 14 so that a parallel contact between the heating element 42 and the vessel to be heated may be obtained. The floating of the heating element 42 in comparison to the vessel support subassembly 14 is accomplished through relative movement of 70 versus 72 and 78 versus 84 as such movement applies to spring 100.

When weight is placed on the heating element 42 it is transferred through the heating element support arms 40 and the element hub plates 56 and 62 to the screw collar 60. The screw collar 60 is supported on the upper screw sleeve 70. Screw collar 60 and the upper screw sleeve 70 are held in a vertical alignment relationship by the vertical connection screw 58. Weight is transferred from the screw collar 60 through the upper screw sleeve 70 to the top of the center post spring 76. The weight spring is preloaded and does not compress and transfers the force to the lower screw sleeve 78 through the center post spring 76. In this manner, the heating element 42 is spring raised to a level position but may move angularly to ensure a proper contact of the heating element 42 and the vessel being heated.

The vertical adjustment of the heating element 42 is obtained by raising and lowering the entire heating element subassembly 34 by flat spring 100. The weight of the heating element subassembly 34 is also supported through center post spring 76 to the lower screw sleeve 78. By raising and lowering the entire center post 50, screw sleeves 78 and 70, the center post spring 76, and the screw collar 60, the heating element subassembly 34 may be raised and lowered.

The raising and lowering of the entire heating element subassembly 34 is accomplished by raising and lowering the lower screw sleeve 78. The lower screw sleeve 78 supports the weight of the heating element subassembly 34. In turn, the lower screw sleeve 78 transfers the weight through the center post support washer 82 to the center post lock nut 80. The center post lock nut 80 is attached to the vertical connection screw 58. The center post lock nut 80 and bottom of the vertical connecting screw 58 are raised and lowered by the flat spring 100 of the heating element actuator subassembly 20. Thus, raising and lowering the flat spring 100 of the heating element actuator subassembly 20 will also raise and lower the heating element 42. This allows for a vertical adjustment of the heating element 42. Deflection of flat spring 100 allows a floating relationship to ensure proper contact of 42 and the vessel.

Figure 7:
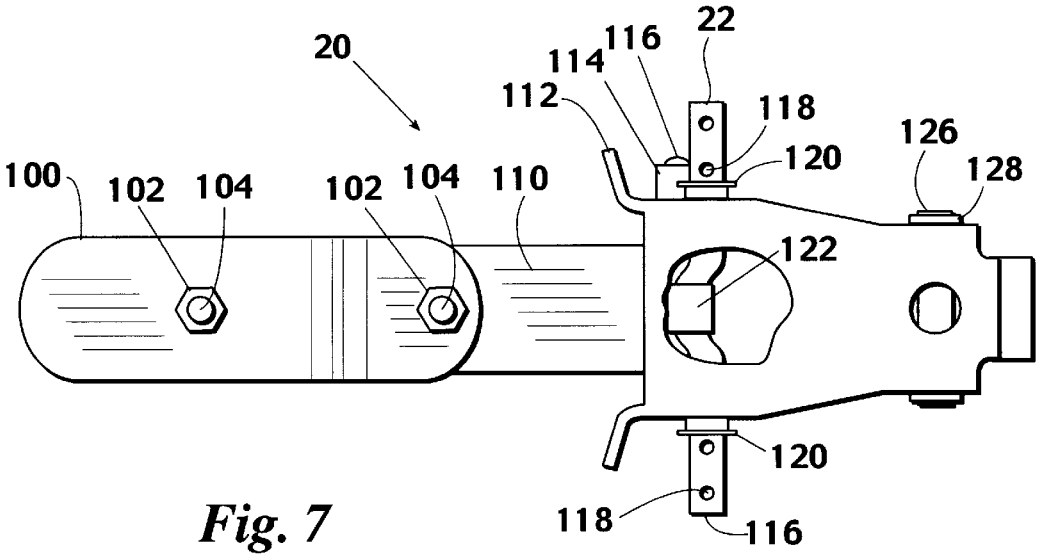
FIG. 7 is a top view of the heating element actuator assembly.
Figure 8:
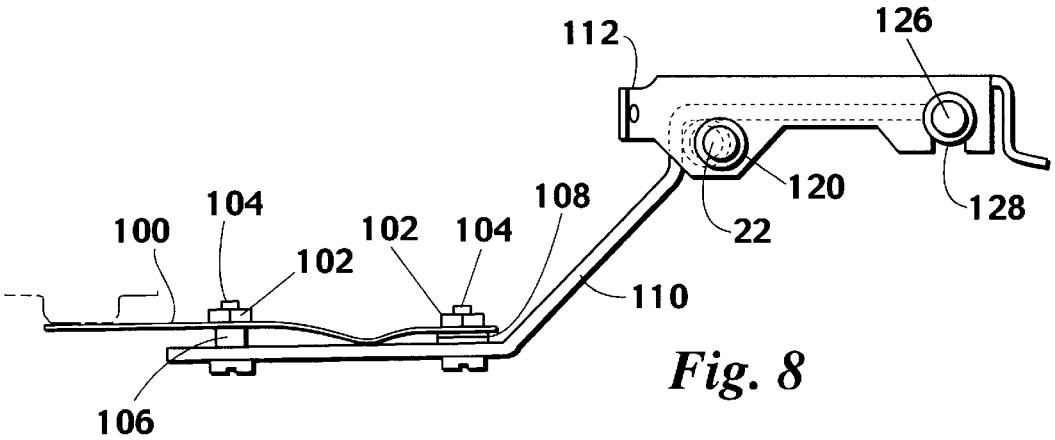
FIG. 8 is a side view of the heating element actuator assembly shown in the lowered position.
Figure 9:
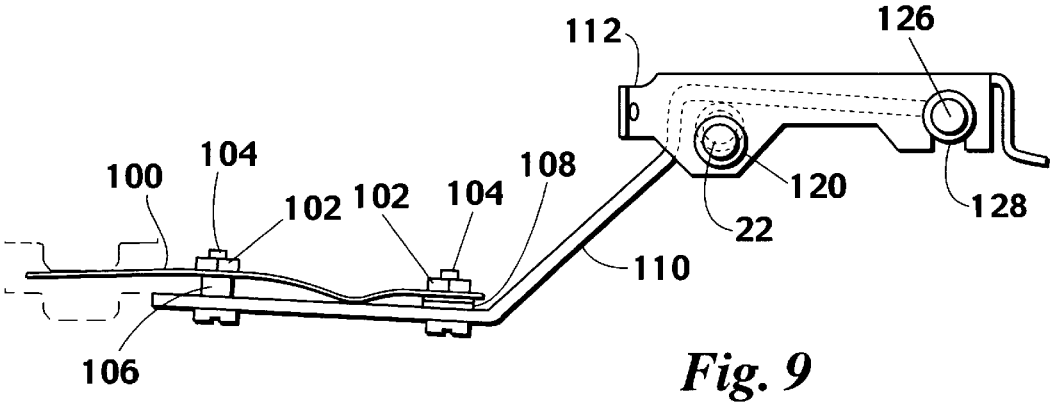
FIG. 9 is a side view of the heating element actuator assembly shown in a raised position.

FIGS. 7 through 9 show the general construction for the heating element actuator subassembly 20. As shown by the dashed lines in FIG. 8, the heating element actuator subassembly 20 is designed to press against the bottom of the vertical connection screw 58 and the center post lock nut 80 of the vertical connecting assembly 50. This connection allows for the heating element actuator subassembly 20 to raise and lower heating element 42 in relation to the vessel support subassembly 14.

The heating element actuator subassembly 20 is constructed from a flat spring 100 which is attached to an actuator arm 110 in two separate locations. The actuator arm 110 is formed from a ⅛"×1" stainless steel bar. The flat spring 100 is formed from a 0.025 stainless steel.

The flat spring 100 is first attached to the actuator arm 110 at the end of the actuator arm 110. The flat spring 100 is attached by an arm screw 104 and arm nut 102, and is kept distanced from the actuator arm 110 by a spring spacer 106. One end of the flat spring 100 is attached to the midpoint of the actuator arm 110 by means of an arm screw 104 and arm nut 102. This second end of the flat spring 100 is kept in a distanced relationship to the actuator arm 110 by spring washer 108. In this manner, it may be seen that the flat spring 100 may move in a springed relationship against the actuator arm 110. Flat spring 100 has a bend between the first and second attachment locations which allows for the flat spring to provide a controlled preset spring force when contacting center post lock nut 80 as heating element subassembly 34 is raised to contact the vessel to be heated.

The actuator arm 110 is attached to the support bracket 112 so that the actuator arm 110 may be raised and lowered in comparison to the support bracket 112. The support bracket 112 is attached to the range top orifice flange (not shown). The support bracket 112 is formed from a 0.060 stainless steel. The actuator arm 110 is raised and lowered by the turning of a lift cam 122 which is attached to the heating element actuator shaft 22. The lift cam roller 122 is formed from a 7/16" diameter BRG bronze. The heating element actuator shaft 22 is held in place by shaft bushings 120. The shaft bushings 120 are mounted in associated holes in the support bracket 112. The shaft bushings 120 and pilot shaft bushing 128 are formed from a ⅜" round brass.

The range of movement of the heating element actuator shaft 22 is controlled by a shaft pin 26 (not shown) which works against the stop post 114. The stop post 114 is attached to the support bracket 112 by means of a stop post attachment 116, such as a screw, bolt, weld or other means. The stop post 114 is formed from a ⅜" round brass.

The bracket end of the actuator arm 110 is secured to a pivot shaft 126. The pivot shaft 126 is formed from a 7/32" diameter annealed stainless steel rod. The pivot shaft 126 rides within pivot shaft bushings 128 that are mounted in associated holes in the support bracket 112. Thus, the actuator arm 110 and flat spring 100 is raised and lowered by means of a cam roller 122 operating around the heating element actuator shaft 22. The actuator arm 110 and flat spring 100 form an assembly which pivots around the pivot shaft 126 which rides in the pivot shaft bushings 128. In this manner it can be seen that the pivoting of the heating element actuator shaft 22 raises and lowers the flat spring 100 which raises and lowers the vertical connecting assembly 50 which is connected to raise and lower the heating element 42.

The switch installation subassembly 18 uses standard and well known mounting methods to secure the switch installation subassembly 18 to the heating element actuator subassembly 20.

Figure 10:
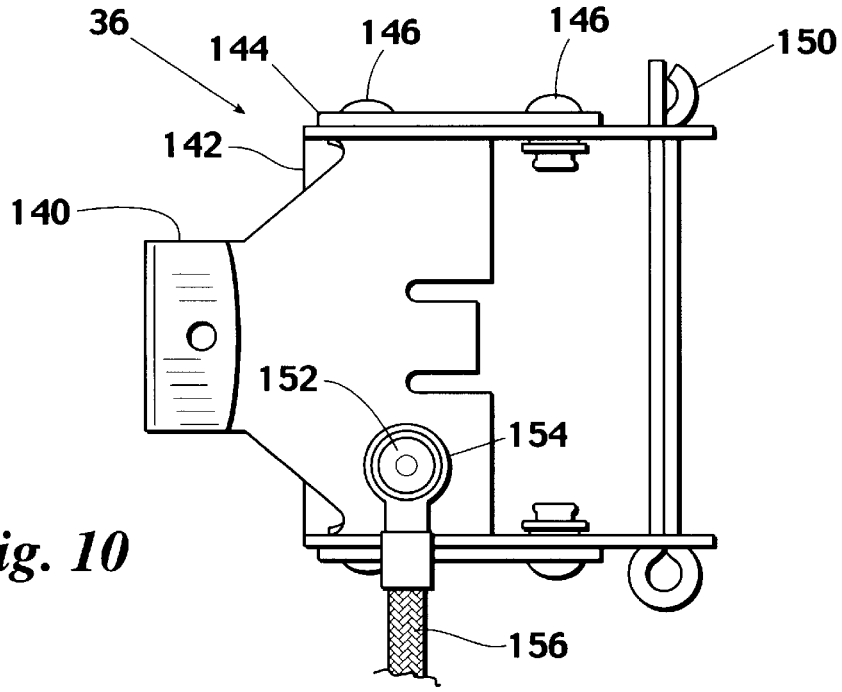
FIG. 10 is a top view of the heating element connection receptacle subassembly.
Figure 11:
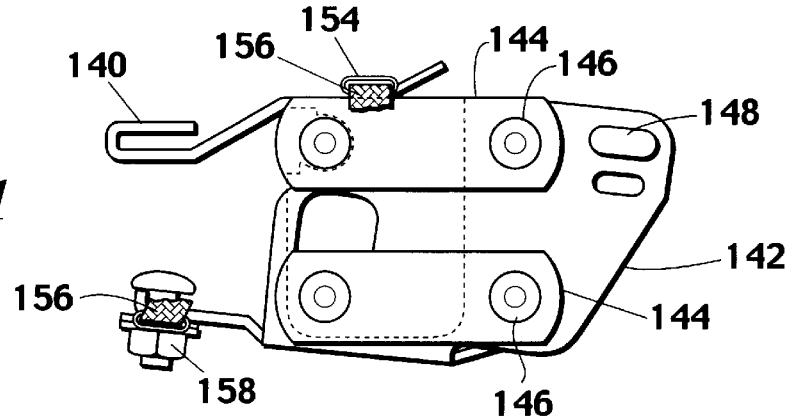
FIG. 11 is a side view of the heating element connection receptacle subassembly shown in a raised position.
Figure 12:
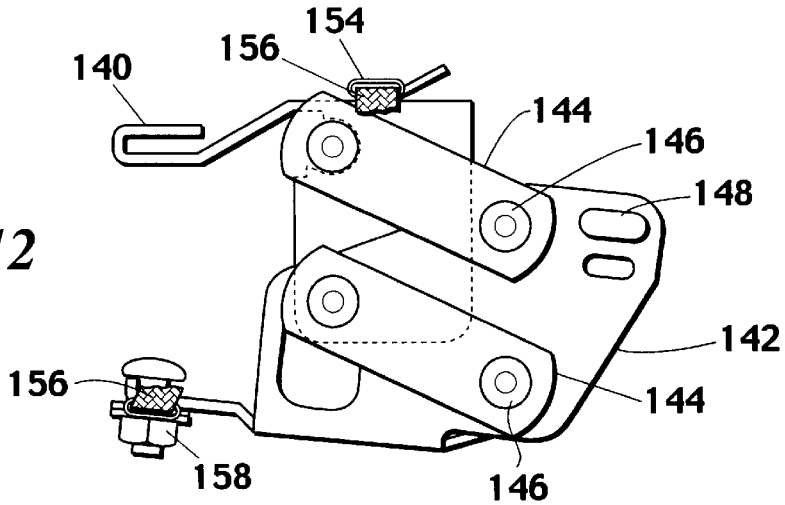
FIG. 12 is a side view of a heating element connection receptacle subassembly shown in a lowered position.

FIGS. 10 through 12 show the heating element connector receptacle subassembly 36. The receptacle support bracket 140 is securely attached to the range top orifice flange (not shown). The receptacle support bracket 140 is formed from a 0.048 stainless steel. The receptacle support bracket 140 is attached to the receptacle holder 142 through links 144. The receptacle holder 142 is formed from a 0.035 stainless steel. The links 144 are formed from a 0.060 stainless steel.

The links 144 are attached by rivets 146 and spacers to both the receptacle support bracket 140 and the receptacle holder 142. By using multiple links 144, the receptacle holder 142 is kept in a parallel relationship to the receptacle support bracket 140. This allows for the raising and lowering of the burner connection terminal receptacle along with the burner connection terminal 48. The burner connection terminal receptacle (not shown) restricted in place by cotter pin 150 which fits through pin slots 148. In the preferred embodiment, the cotter pin 150 is a ⅛"×2½" stainless steel cotter pin.

The receptacle support bracket 140 is in grounded connection with the receptacle holder 142 through ground strap 156. The grounding strap 156 is attached to the receptacle support bracket 140 through the ground terminal 154 which is attached to the receptacle support bracket 140 by ground terminal rivet 152. The grounding strap 156 is formed from a tinned copper flat braid, 14 AWG. The opposite end of the grounding strap 156 is attached to the receptacle holder 142 through ground strap bolt 158. In this manner the entire heating element connector receptacle subassembly 36 is grounded to the range top.

Figure 13:
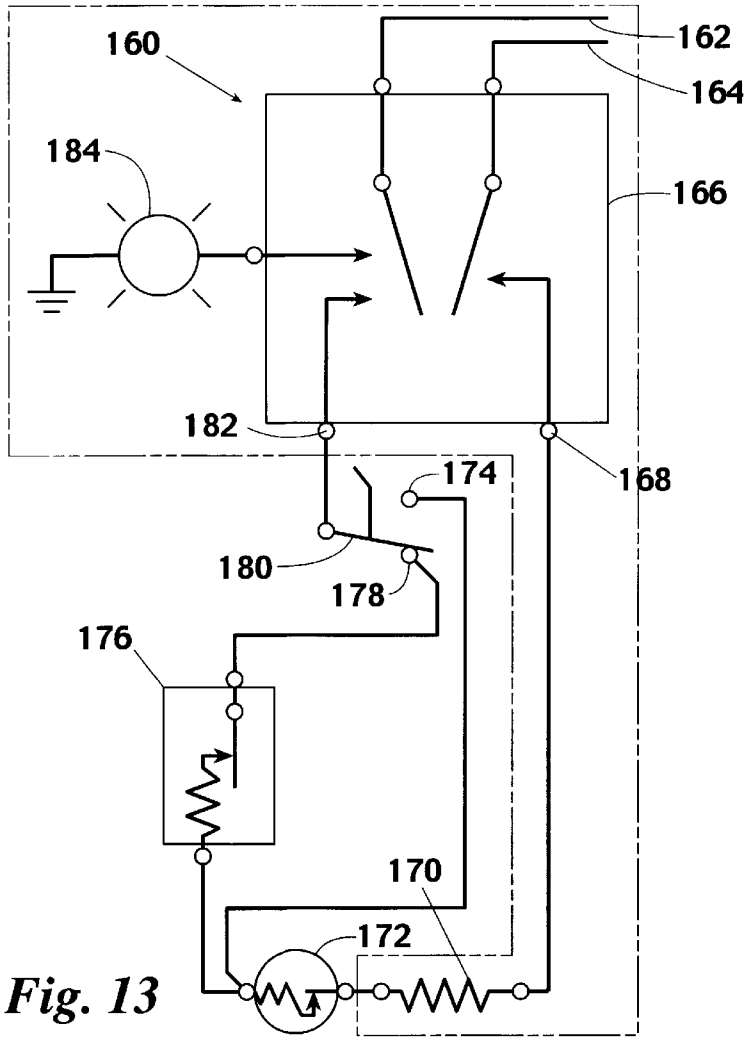
FIG. 13 is an electrical schematic view of the thermal sensing and actuation circuit of the burner assembly shown in FIG. 1.

FIG. 13 of the drawings shows a general overview of the wiring schematic 160 of the present invention. In general, the heating element of the present invention is powered by either 220, 60 Hz AC or can alternatively be powered by a 208V system.

The input electrical power is shown by line 1, 162 and line 2, 164. The electrical power lines 162 and 164 feed into the main control 166. The main control 166 is a standard control known very well in the prior art. A typical installation of the main control 166 also includes an arrangement for a pilot light 184 as shown in the present schematic. The main control 166 has a first terminal 168 and a second terminal 182. The first terminal 168 is connected through the heating element 170 which is schematically represented as a resistor. The heating element 170 is then connected through a thermal safety switch 172. The end of the thermal safety switch 172 is connected to both a first bypass terminal 174 and a preset thermal switch 176. The other end of the present thermal switch 176 is connected to a second bypass terminal 178. The first and second bypass terminals 174 and 178 are connected to a thermal switch bypass 180. In this manner, either a direct connection can be made to thermal safety switch 172 or a connection through the preset thermal switch 176 can be made to the thermal safety switch 172. The opposite end of the thermal switch bypass 180 is connected to the main control second terminal 182. The thermal switch bypass 180 is actuated by the element actuator shaft 22 so that contact is made between terminal 182 and 178 when the element is in the lowered position.

While the foregoing detailed description has described several embodiments of the raisable burner assembly in accordance with this invention, it is to be understood that the above description is illustrative only and not limiting of the disclosed invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A burner assembly, comprising:

a drip bowl;

a vessel support assembly supported by said drip bowl;

a heating element actuator assembly supported by a range top;

a heating element assembly supported by said heating element actuator assembly; and a hold down means attached to said vessel support assembly.

2. A burner assembly, comprising:

a drip bowl;

a vessel support assembly supported by said drip bowl;

a heating element actuator assembly supported by a range top;

a heating element assembly supported by said heating element actuator assembly; and at least one leveling stop to self-align said heating element.

3. The burner assembly of claim 1, wherein the action of self-aligning takes place when said heating element is in a raised position.

4. The burner assembly of claim 1, wherein the action of self-aligning takes place when said heating element is in a lowered position.

5. A burner assembly, comprising:

a drip bowl;

a vessel support assembly supported by said drip bowl;

a heating element actuator assembly supported by a range top;

a heating element assembly supported by said heating element actuator assembly; and a vessel connection assembly for movable attaching said vessel support assembly to said heating element assembly, said vessel connection assembly having a screw collar, a vertical connection post contained within said screw collar, a center post spring supporting the bottom end of said screw collar and a lower screw sleeve supporting the bottom end of said center post spring.

6. The vessel connecting assembly of claim 5, further comprising:

at least one post sleeve for aligning said screw sleeve in a vertical manner.

7. A burner assembly, comprising:

a drip bowl;

a cam operated flat spring arm;

a vessel support assembly supported by said drip bowl;

a heating element actuator assembly supported by a range top; and a heating element assembly supported by said heating element actuator assembly.

* * * * *